US006782556B2

(12) United States Patent
Grilliot et al.

(10) Patent No.: US 6,782,556 B2
(45) Date of Patent: Aug. 31, 2004

(54) PROTECTIVE HOOD HAVING NECK-COVERING AND SHOULDER-COVERING SECTION WITH IMPROVED PROPERTIES

(75) Inventors: William L. Grilliot, Dayton, OH (US); Mary I. Grilliot, Dayton, OH (US); Patricia Lewis, Huber Heights, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 86 days.

(21) Appl. No.: 10/294,365

(22) Filed: Nov. 14, 2002

(65) Prior Publication Data

US 2003/0204895 A1 Nov. 6, 2003

Related U.S. Application Data

(63) Continuation-in-part of application No. 10/136,564, filed on May 1, 2002, now Pat. No. 6,662,375.

(51) Int. Cl.[7] ..... A42B 1/04
(52) U.S. Cl. ..... 2/202
(58) Field of Search ..... 2/202, 206, 174, 2/69.5

(56) References Cited

U.S. PATENT DOCUMENTS

| | | | | |
|---|---|---|---|---|
| 4,573,217 | A | 3/1986 | Reed | |
| 4,972,520 | A | 11/1990 | Grilliot et al. | |
| 5,090,054 | A | 2/1992 | Grilliot et al. | |
| 5,109,549 | A | 5/1992 | Mattinson | |
| 5,628,065 | A | 5/1997 | Austin | |
| 5,873,132 | A | 2/1999 | Grilliot et al. | |
| 6,006,360 | A | 12/1999 | Reed | |
| 6,260,207 | B1 | 7/2001 | Barbeau et al. | |
| 6,662,375 | B2 * | 12/2003 | Lewis | 2/202 |

* cited by examiner

*Primary Examiner*—Katherine Moran
(74) *Attorney, Agent, or Firm*—Wood, Phillips, Katz, Clark & Mortimer

(57) ABSTRACT

In a protective hood having an upper head-covering section, an anterior head-covering section, a posterior head-covering section, and a lower neck-covering and shoulder-covering section, the lower neck-covering and shoulder-covering section differs from each of the other sections in abrasion resistance properties, thermal insulation properties, and moisture barrier properties, or one or two of those properties. Preferably, the lower neck-covering and shoulder-covering section has plural layers, which include an outer abrasion-resistant layer, an intermediate thermally insulative layer, and an inner moisture barrier layer.

7 Claims, 1 Drawing Sheet

PROTECTIVE HOOD HAVING NECK-COVERING AND SHOULDER-COVERING SECTION WITH IMPROVED PROPERTIES

CROSS-REFERENCE TO RELATED APPLICATION

This application is a continuation-in-part of U.S. patent application Ser. No. 10/136,564, now U.S. Pat. No. 6,662,375, which was filed on May 1, 2002, and the disclosure of which is incorporated herein by reference.

TECHNICAL FIELD OF THE INVENTION

This invention pertains to a protective hood, as worn by a firefighter or an emergency worker, of a type having an upper head-covering section, an anterior head-covering section, a posterior head-covering section, and a lower neck-covering and shoulder-covering section. Commonly, such a hood is worn by a firefighter, who may be inadvertently exposed to water at high pressure from a fire hose or to potentially injurious heat from a fire.

BACKGROUND OF THE INVENTION

Protective hoods of the type noted above are exemplified in U.S. Pat. Nos. 4,972,520, 5,090,054, and 5,873,132, the disclosures of which are incorporated herein by reference, and are available commercially from Morning Pride Manufacturing, L.L.C. of Dayton, Ohio.

As exemplified in those patents, protective hoods have respective head-covering and shoulder-covering portions made from similar, comparatively heavier, thermally insulative material, except that upper head-covering portions are made from comparatively lighter material, such as mesh or netting, which allows thermal energy to pass readily.

In the protective hood illustrated and described in U.S. patent application Ser. No. 10/136,564, supra, the anterior head-covering section is made from comparatively heavier, thermally insulative material, whereas the upper head-covering section and the other sections, or a selected one of the other sections, are made from similar, comparatively lighter material, such as mesh or netting, whereby to allow heat to pass readily through those sections made from comparatively lighter material.

Protective hoods of related interest are exemplified in U.S. Pat. No. 4,573,217 and in U.S. Pat. No. 5,628,065.

SUMMARY OF THE INVENTION

Broadly, this invention contemplates that in protective hood having an upper head-covering section, which when the protective hood is worn covers an upper portion of a wearer's head, an anterior head-covering section, which when the protective hood is worn covers an anterior portion of the wearer's head, the anterior head-covering section having a window, through which portions of the wearer's face are exposed when the protective hood is worn, a posterior head-covering section, which when the protective hood is worn covers a posterior portion of the wearer's head, and a lower neck-covering and shoulder-covering section, which when the protective hood is worn covers portions of the wearer's shoulders, the lower neck-covering and shoulder-covering section differs from each of the other sections in thermal insulation properties, and moisture barrier properties, or in one or two of those properties.

Preferably, the lower neck-covering and shoulder-covering section has plural layers, which may include a moisture barrier layer. In a preferred embodiment, those layers include an outer abrasion-resistant layer and an inner moisture barrier layer and, moreover, may include an intermediate thermally insulative layer.

DETAILED DESCRIPTION OF THE ILLUSTRATED EMBODIMENTS

Figure 1:
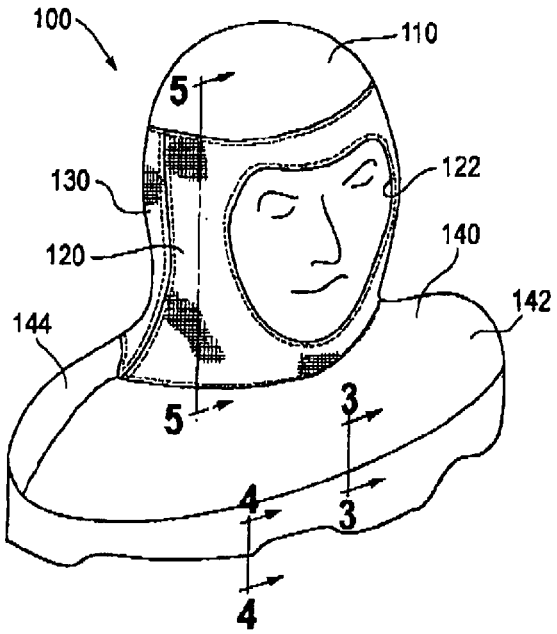
FIG. 1 is a perspective view of a protective hood constituting a first embodiment of this invention, as worn by a wearer whose face appears. A protective coat, with which the protective hood is worn, is shown fragmentarily.

As illustrated, a protective hood 100, as worn by a firefighter, has an upper head-covering section 110, an anterior head-covering section 120 having a window 122, through which portions of a wearer's face are exposed when the protective hood 100 is worn, a posterior head-covering section 130, and a lower neck-covering and shoulder-covering section 140 made in two subsections sewn together, namely, an anterior subsection 142 and a posterior subsection 144. The respective sections 110, 120, 130, 140, are sewn together. The protective hood 200 is worn with a protective coat 200, which has plural layers conventional in turnout coats for firefighters, i.e., an outer abrasion-resistant layer 202, an intermediate thermally insulative layer 204, and an inner moisture barrier layer 206.

Figure 2:
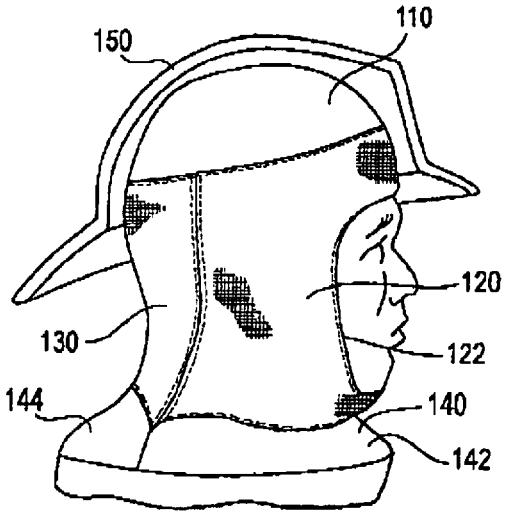
FIG. 2 is a side elevation of the protective hood, as worn by the same wearer with a protective helmet appearing in cross-section.
Figure 3A:
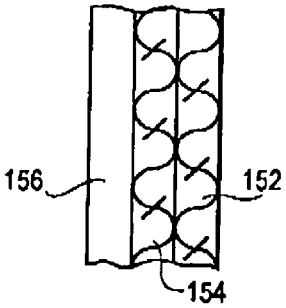
FIG. 3A, 3B, and 3C are fragmentary, cross-sections, each illustrating a different embodiment, as taken along line 3—3 of FIG. 1, in a direction indicted by arrows.

The lower neck-covering and shoulder-covering section 140 of the protective hood 100 differs from each of its other sections 110, 120, 130, in abrasion resistance properties, thermal insulation properties, and moisture barrier properties. Thus, as illustrated in FIGS. 1, 2, and 3A, each of the anterior and posterior subsections 142, 144, of the lower neck-covering and shoulder-covering section 140 has plural layers, which include an outer abrasion resistant layer 152 similar to the outer abrasion resistant layer 202 of the protective coat 200, an intermediate thermally insulative layer 154 similar to the intermediate thermally resistant layer 204 of the protective coat 200, and an inner moisture barrier layer 156 similar to the inner moisture barrier layer 206 of the protective coat 200.

Figure 3B:
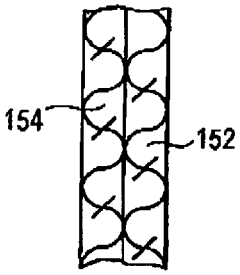
Figure 5:
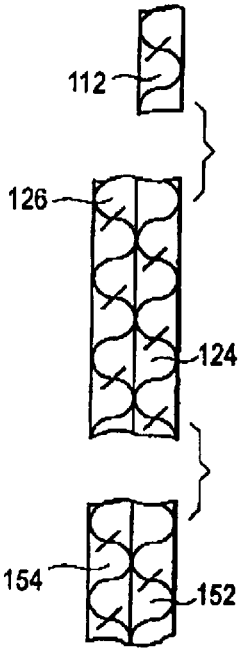
FIGS. 4 and 5 are fragmentary, cross sections taken along lines 4—4 and 5—5 of FIG. 1, respectively, in directions indicated by arrows.
Figure 3C:
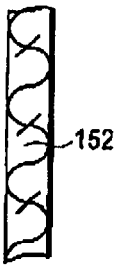
Figure 4:
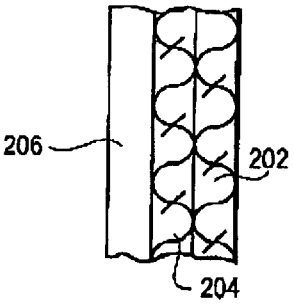

FIG. 3B illustrates a simplified embodiment, in which the moisture barrier layer 156 has been omitted. FIG. 3C illustrates a simplified embodiment, in which the thermally insulative layer 154 and the moisture barrier layer 156 have been omitted. FIG. 5 illustrates that the simplified embodiment of FIG. 3B is useful if the upper head-covering section 100 has a single layer 112 and if each of the head-covering sections 120, 130, has two layers 126, 124, while none of the respective sections 110, 120, 130, 140, has a moisture barrier layer, such as the moisture barrier layer 156 of the preferred embodiment of FIG. 3A.

In a preferred mode for carrying out this invention, as illustrated, the lower neck-covering and shoulder-covering section 140 of the protective hood 100 is worn over the shoulder-covering portions of the protective coat 200. Thus, because it has the moisture barrier layer 156, the shoulder-covering section 140 of the protective hood 100 protects a firefighter wearing the protective hood 100 and the protective coat 200 against infiltration, into the protective coat 200, of water that may be inadvertently sprayed from a fire hose, against the shoulder-covering portion 140 of the protective hood 100. Also, because it has the thermally insulative layer 204, the shoulder-covering section 140 of the protective hood 100 coacts with the thermally insulative layer 204 of the protective coat to protect a firefighter wearing the protective hood 100 and the protective coat 200 against potentially injurious heat from a fire.

What is claimed is:

1. A protective hood having an upper head-covering section, which when the protective hood is worn covers an upper portion of a wearer's head, an anterior head-covering section, which when the protective hood is worn covers an anterior portion of the wearer's head, the anterior head-covering section having a window, through which portions of the wearer's face are exposed when the protective hood is worn, a posterior head-covering section, which when the protective hood is worn covers a posterior portion of the wearer's head, and a lower neck-covering and shoulder-covering section, which when the protective hood is worn covers portions of the wearer's shoulders, wherein the lower neck-covering and shoulder-covering section differs from each of the other sections in properties of abrasion resistance, thermal insulation properties, and moisture barrier properties, or in one or two of those properties.

2. The protective hood of claim 1 wherein the lower neck-covering and shoulder-covering section has a single layer.

3. The protective hood of claim 1 wherein the lower neck-covering and shoulder-covering section has plural layers, which include a moisture barrier layer.

4. The protective hood of claim 3 wherein none of the other sections includes a moisture barrier layer.

5. The protective hood of claim 1 wherein the lower neck-covering and shoulder-covering section has an abrasion resistant layer and a thermally insulative layer.

6. The protective hood of claim 5 wherein the lower neck-covering and shoulder-covering section also has a moisture barrier layer.

7. The protective hood of claim 5 wherein the lower neck-covering and shoulder-covering section does not have a moisture barrier layer.

* * * * *